US011510505B2

(12) United States Patent
Lee et al.

(10) Patent No.: US 11,510,505 B2
(45) Date of Patent: Nov. 29, 2022

(54) TABLEWARE TAKING DEVICE AND ITS ROTATION-TYPE MISALIGNMENT MATERIAL DISCHARGE STRUCTURE

(71) Applicant: Kolor Magnetic (Shenzhen) Co., Ltd., Guangdong (CN)

(72) Inventors: Ching Mou Lee, Guangdong (CN); Chi Wai Lee, Guangdong (CN)

(73) Assignee: Kolor Magnetic (Shenzhen) Co., Ltd., Shenzhen (CN)

( * ) Notice: Subject to any disclaimer, the term of this patent is extended or adjusted under 35 U.S.C. 154(b) by 0 days.

(21) Appl. No.: 17/326,311

(22) Filed: May 20, 2021

(65) Prior Publication Data

US 2022/0202204 A1 Jun. 30, 2022

(30) Foreign Application Priority Data

Dec. 30, 2020 (CN) ..... 202011612996.3

(51) Int. Cl.
*A47F 1/10* (2006.01)

(52) U.S. Cl.
CPC ..... *A47F 1/10* (2013.01); *A47F 2001/103* (2013.01)

(58) Field of Classification Search
CPC ..... A47F 1/10
See application file for complete search history.

(56) References Cited

U.S. PATENT DOCUMENTS 5,551,596 A * 9/1996 Oomori ..... A44B 19/60 221/113
2010/0084418 A1* 4/2010 Reinsel ..... A47F 1/10 221/124

* cited by examiner

*Primary Examiner* — Gene O Crawford
*Assistant Examiner* — Ayodeji T Ojofeitimi

(57) ABSTRACT

A rotation-type misalignment material discharge structure is provided. It has a support block and a drive element. The support block comprises a rotation shaft, a first support sheet and a second support sheet stacked on the rotation shaft successively. The first support sheet comprises a first support portion and a first material discharge portion, the second support sheet comprises a second support portion and a second material discharge portion. The first and second material discharge portions are misaligned in a perpendicular direction. One end of the rotation shaft is in transmission connection with the drive element; wherein the support block is rotated for discharging the material under a drive of the drive element. The support block is rotated for discharging the material under a drive of the drive element, such that the in-situ material falling is accurate and reliable without requiring any forward, backward, leftward or rightward movement.

17 Claims, 6 Drawing Sheets

TABLEWARE TAKING DEVICE AND ITS ROTATION-TYPE MISALIGNMENT MATERIAL DISCHARGE STRUCTURE

CROSS REFERENCE TO RELATED APPLICATIONS

The present application claims the benefit of Chinese Patent Application No. 202011612996.3 filed on Dec. 30, 2020, the contents of which are incorporated herein by reference in their entirety.

TECHNICAL FIELD

The present disclosure relates generally to a mechanical equipment field, and more particularly, to a rotation-type misalignment material discharge structure and a tableware taking device having the same.

BACKGROUND

With the development of the catering industry, a tableware taking device presents in the market. The tableware taking device is provided with a support block for supporting the tableware, an inclined chute for guiding the falling tableware. The tableware discharge of the tableware taking device is as follows. A slide block is arranged at the end of the inclined chute, and a pushing element is arranged next to the tableware in the bottommost layer in a magazine accommodating a plurality of tableware. One end of the slide block is connected with the pushing element, while the other end of the slide block is connected to the fallen tableware. Accordingly, when the fallen tableware is pulled, the slide block would be pulled too, thus driving the pushing element to pull the tableware in the bottommost layer in the magazine out. However, due to the large size of the slide block, the weight of the tableware taking device will be increased and it would be difficult to move. Meanwhile, when the tableware in the bottommost layer in the magazine is pushed by the pushing element, it may not be completely displaced from the support block to fall off, so the tableware discharge is not reliable. Furthermore, sometimes the tableware will be stuck in the magazine. At this time, all the tableware in the magazine should be taken out and then stacked back into the magazine in turns for discharging the tableware. These procedures are numerous and cumbersome, which greatly affects the dining time.

SUMMARY

The object of the present application is to provide a rotation-type misalignment material discharge structure and a tableware taking device having the same, aiming at the above problems of the prior art.

In one aspect, a rotation-type misalignment material discharge structure is provided, which comprising a support block and a drive element; wherein the support block further comprises a rotation shaft, a first support sheet and a second support sheet stacked on the rotation shaft successively; wherein the first support sheet comprises a first support portion for supporting a material and a first material discharge portion for discharging the material, the second support sheet comprises a second support portion for supporting the material and a second material discharge portion for discharging the material, wherein the first material discharge portion and the second material discharge portion are misaligned in a perpendicular direction; wherein one end of the rotation shaft is in transmission connection with the drive element; wherein the support block is rotated for discharging the material under a drive of the drive element.

Preferably, the first material discharge portion and the second material discharge portion are concave notches on the first support sheet and the second support sheet respectively.

Preferably, the first support portion is a convex portion protruding on the first support sheet, while the second material discharge portion is a concave notch on the second support sheet.

Preferably, the support block further comprises a third support sheet, wherein the first support sheet, the second support sheet and the third support sheet are stacked on the rotation shaft successively; wherein the third support sheet comprises a third support portion for supporting the material and a third material discharge portion for discharging the material; wherein the third material discharge portion is a concave notch on the third support sheet, the first material discharge portion, the second material discharge portion and the third material discharge portion are misaligned in the perpendicular direction.

Preferably, the first support sheet is provided with a position limitation portion.

Preferably, the drive element comprises two pull rods correspondingly arranged and a pull end respectively connected with the pull rods, wherein at least four support blocks are arranged, each two support blocks are connected with the pull rod on one side of the drive element, one end of the rotation shaft is arranged with a drive gear, the pull rod is provided with a gear pattern meshed with the drive gear, wherein the pull end can pull the four support blocks at the same time under an action of an external force.

Preferably, the pull rod is provided with a positioning pin, and spacing washers are arranged among the first support sheet, the second support sheet and the third support sheet, respectively.

Preferably, the pull end is provided with a first pull portion for pulling the drive element, which comprises a gear rack connected with the pull end, a pull gear meshed with the gear rack, and a motor connected with the pull gear for driving the pull gear to roll.

Preferably, the pull end is provided with a second pull portion for pulling the drive element, which comprises a pulling device and a fixation pin for mounting the pulling device on the pull end.

Preferably, a synchronous wheel is arranged at one end of the rotation shaft, while the drive element is a belt pulling the synchronous wheel to rotate the support block.

Preferably, one end of the rotation shaft is arranged with a slide block, while the drive element is a slide plate cooperated with the slide block and arranged on the pull rod; wherein when the drive element is pulled repeatedly, the slide block can be slid through the slide plate.

Preferably, one end of the rotation shaft is arranged with a ratchet wheel, while the drive element is a protrusion cooperated with the ratchet wheel; wherein the protrusion can push the ratchet wheel to rotate.

In a further aspect, a tableware taking device comprising the above rotation-type misalignment material discharge structure is provided, which comprising a housing, a magazine arranged inside the housing, under which the rotation-type misalignment material discharge structure is arranged; wherein a guide chute for sliding a tableware is formed in the housing and arranged under the rotation-type misalignment material discharge structure; wherein the housing is provided with a tableware taking opening arranged at an end of the guide chute.

Preferably, a door opening structure is arranged at the tableware taking opening, wherein the door opening structure comprises a first baffle provide with a first connection column and a second baffle provide with a second connection column; wherein the first connection column is provided with a first door pulling gear while the second connection column is provided with a second door pulling gear; wherein both sides of the pull end are respectively provided with a first pulling gear pattern meshed with the first door pulling gear and a second pulling gear pattern meshed with the second door pulling gear.

Preferably, the pull end is provided with a reset spring which abuts to the housing.

Preferably, the guide chute comprises three guide columns arranged in parallel with each other, and in a slope-shape or a stair-step shape, successively.

Preferably, the tableware taking opening is further arranged with a seal insert and a position limitation groove in which the seal insert can be inserted into and slide therein.

Preferably, a fixation button is arranged on the seal insert.

The present disclosure has provided a rotation-type misalignment material discharge structure and a tableware taking device having the same, which drives the support block to discharge the tableware through the drive element. When the support block has rotated for a misalignment angle, the tableware in the lower layer would lost its support platform, and then the fall for discharging without any forward, backward, leftward or rightward movement. This is an absolutely different material discharging process when comparing with the prior art, in which the tableware is pulled to move along a straight line for leaving its support platform. Moreover, the rotation-type misalignment material discharge structure in the present application has a simpler and compact structure, smaller size and lighter weight, as the slide block in the prior art has been removed.

BRIEF DESCRIPTION OF THE DRAWINGS

The present application is further illustrated combining the embodiments and drawings attached.

DETAILED DESCRIPTION OF THE PREFERRED EMBODIMENT

Figure 1:
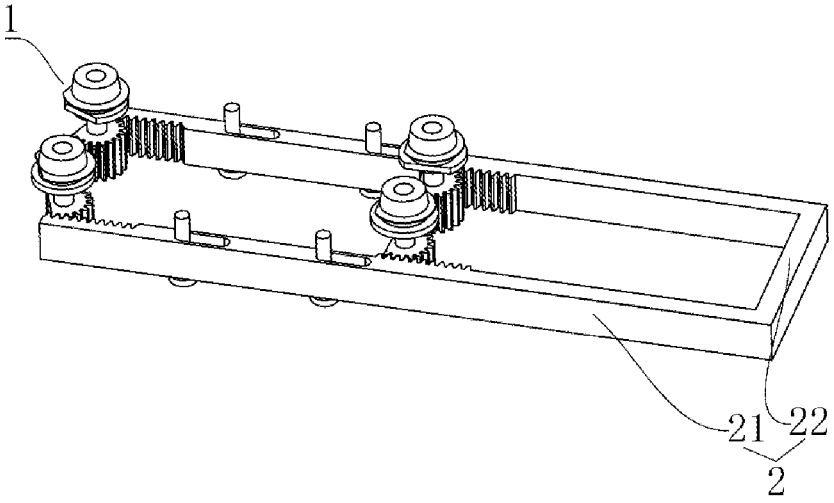
FIG. 1 is a diagram showing the rotation-type misalignment material discharge structure according to a preferable embodiment of the present application.

The structure and operation principle of the present application are further illustrated with reference to the accompanying drawings and embodiments. It should be noted that the accompanying drawings are just simplified schematic diagrams, which only illustrate the basic structure of the present application in a schematic way.

In the description of the present application, it is to be understood that the terms "center", "longitudinal", "transverse", "up", "down", "front", "back", "left", "right", "vertical", "horizontal", "top", "bottom", "inside", "outside", "clockwise", "counterclockwise", and the like, indicate the orientation or positional relationship shown in the drawings. It should be noted that such orientation or positional relationship is just for convenience of description of the present application and simplification of the description, rather than indicate or imply that the pointed device or member must have such certain orientation, must be constructed and operated in a specific orientation. Therefore, such terms should not be understood as a limitation of the present application. For better explanation, the specific embodiments of the present application are described according to the directions shown in FIG. 1.

Figure 2:
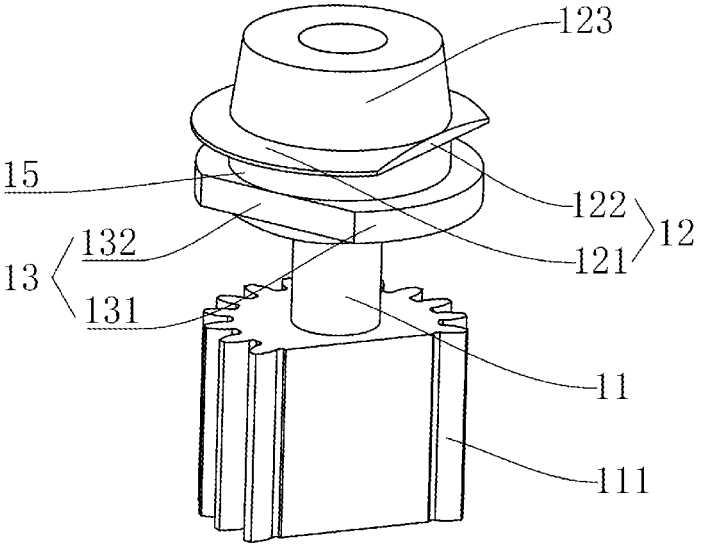
FIG. 2 is a diagram showing the support block and spacing washer in the bilaminar support sheet of the rotation-type misalignment material discharge structure according to a preferable embodiment of the present application.

As shown in FIGS. 1-2, the rotation-type misalignment material discharge structure comprises a support block 1 and a drive element 2. The support block 1 further comprises a rotation shaft 11, a first support sheet 12 and a second support sheet 13 stacked on the rotation shaft 11 successively. The first support sheet 12 comprises a first support portion 121 for supporting a material and a first material discharge portion 122 for discharging the material, the second support sheet 13 comprises a second support portion 131 for supporting the material and a second material discharge portion 132 for discharging the material. The first material discharge portion 122 and the second material discharge portion 132 are misaligned in a perpendicular direction. One end of the rotation shaft 11 is in transmission connection with the drive element 2. The support block 1 is rotated for discharging the material under the drive of the drive element 2. The drive element 2 can pull the support block 1 reciprocally, or pull the support block 1 in the same direction.

Figure 10:
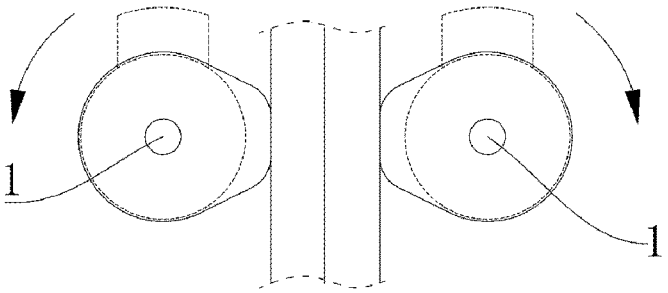
FIG. 10 is a diagram showing the support portion of the support sheet in the rotation-type misalignment material discharge structure according to a preferable embodiment of the present application, in which the support portion is a convex portion.

Preferably, the first material discharge portion 122 and the second material discharge portion 132 are concave notches on the first support sheet 12 and the second support sheet 13 respectively. Preferably, the first support portion 121 is a convex portion protruding on the first support sheet 12, while the second material discharge portion 132 is a concave notch on the second support sheet 13. Or the first support portion 121 and the second support portion 131 are convex portion protruding on the first support sheet 12 and the second support sheet 13 (as shown in FIG. 10).

The materials are stacked on the support block 1. The material in the bottommost layer is placed on the second support portion 131 of the second support sheet 13, the other materials above the material in the bottommost layer are placed on the first support portion 121 of the first support sheet 12. When the drive element 2 pulls the support block 1, the first support sheet 12 and the second support sheet 13 rotate at the same time, then the material in the bottommost layer on the second support sheet 13 is discharged through the second material discharge portion 132. After that, the material in the adjacent layer of the bottommost layer falls from the first material discharge portion 122 to the second support portion 131 of the second support sheet 13.

Preferably, as shown in FIG. 2, the support block 1 further comprises a third support sheet 14, wherein the first support sheet 12, the second support sheet 13 and the third support sheet 14 are stacked on the rotation shaft 11 successively. The third support sheet 14 comprises a third support portion 141 for supporting the material and a third material discharge portion 142 for discharging the material. The third material discharge portion 142 is a concave notch on the third support sheet 14. The first material discharge portion 122, the second material discharge portion 132 and the third material discharge portion 142 are misaligned in the perpendicular direction. The discharge portions of the adjacent support sheets are arranged vertically to each other.

Preferably, the first support sheet 12 is provided with a position limitation portion 123.

When there is only one support block 1, the support block 1 supports one end of the material, and a fixed support portion is arranged at the other end of the material. When there are two support blocks 1, the two support blocks 1 are arranged at both sides of the material, respectively. When there are three support blocks 1, two support blocks 1 are arranged one side of the material, while the other one support block 1 is arranged at the other side of the material.

Preferably, the drive element 2 comprises two pull rods 21 correspondingly arranged and a pull end 22 respectively connected with the pull rods 21. At least four support blocks 1 are arranged, and each two support blocks 1 are connected with the pull rod 21 on one side of the drive element 2. A drive gear 111 is arranged at one end of the rotation shaft 11, and the pull rod 21 is provided with a gear pattern 211 meshed with the drive gear 111. The pull end 22 can pull four support blocks 1 at the same time under an action of an external force.

Figure 9:
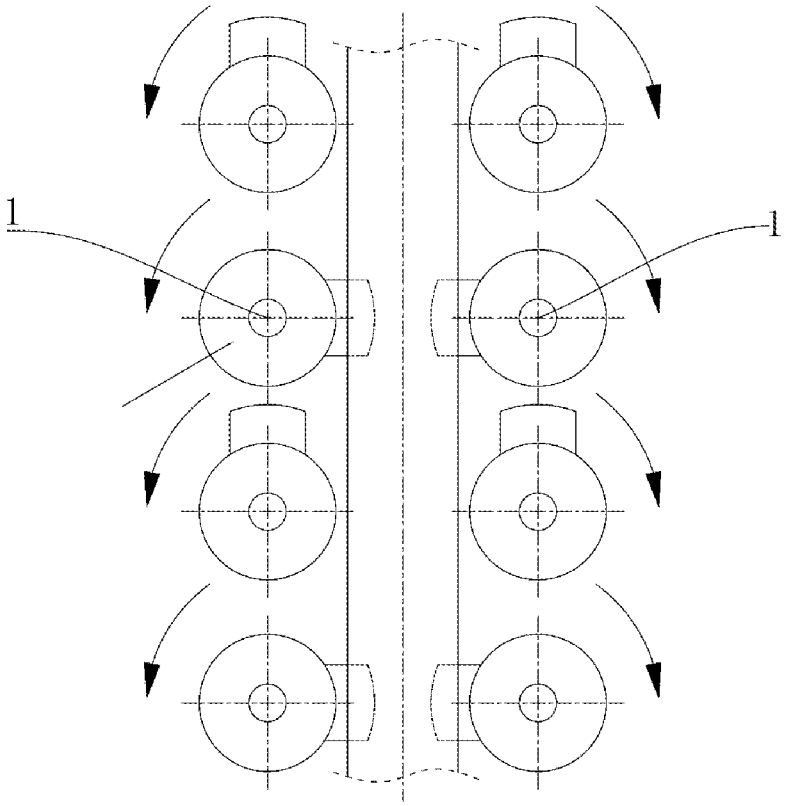
FIG. 9 is a diagram showing the support block having only one support sheet in the rotation-type misalignment material discharge structure according to a preferable embodiment of the present application.

The two support blocks 1 near the first side of the pull rod 21 support the front area and back area of one side of the material, while the two support blocks 1 near the second side of the pull rod 21 support the front area and back area of the other side of the material. In addition, when the support block 1 has only one first support sheet 12, one side of the material is arranged with four support blocks 1. Each two support blocks 1 at each side is used for supporting the material in the bottommost layer, while the other two support blocks 1 at each side is used for supporting the material above the material in the bottommost layer (as shown in FIG. 9).

Figure 6:
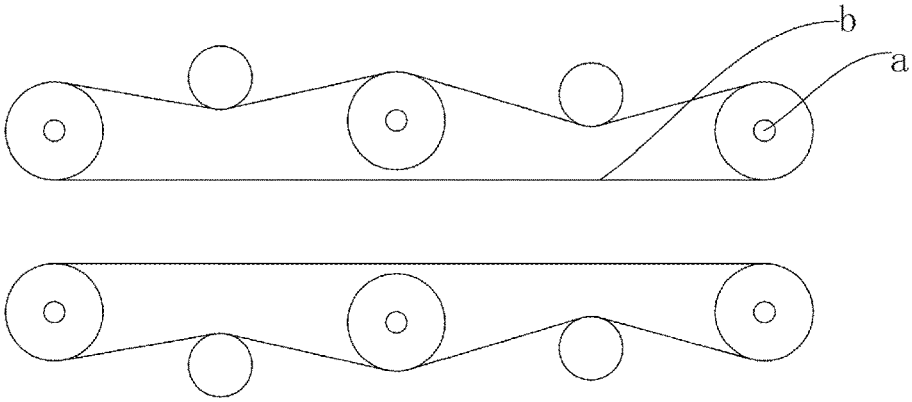
FIG. 6 is a diagram showing the synchronous wheel and belt drive of the rotation-type misalignment material discharge structure according to a preferable embodiment of the present application.
Figure 7:
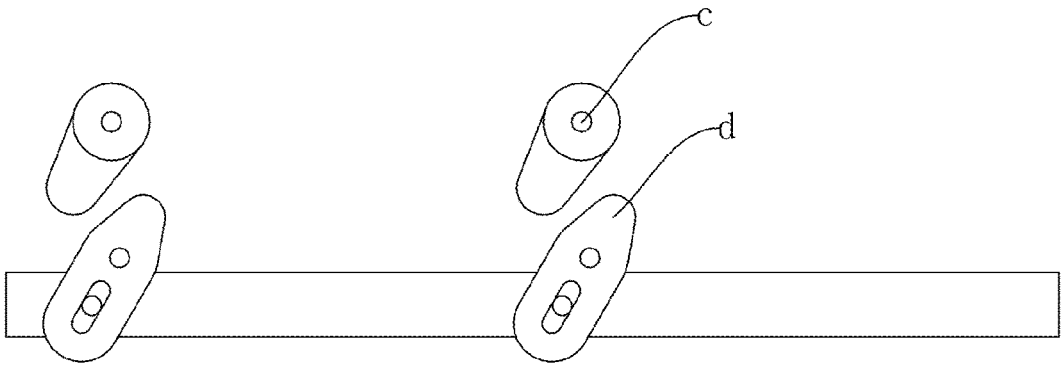
FIG. 7 is a diagram showing the slide block and slide plate drive of the rotation-type misalignment material discharge structure according to a preferable embodiment of the present application.
Figure 8:
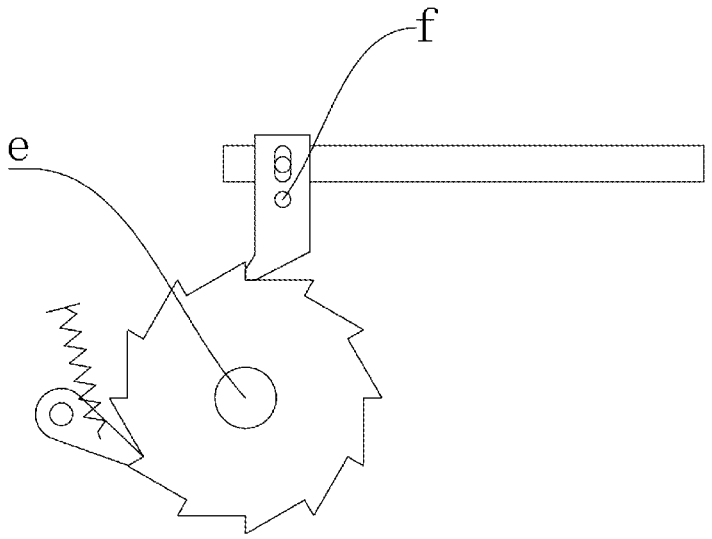
FIG. 8 is a diagram showing the ratchet wheel and protrusion drive of the rotation-type misalignment material discharge structure according to a preferable embodiment of the present application.

Comparing with the prior art of discharging the material through pushing the material by the push block, the cooperation between the drive gear 111 and gear pattern 211 can control the material falling more accurately and prevent the material from getting stuck on the support block 1. In additional, other arrangements can be employed. For example, a synchronous wheel a can be arranged at one end of the rotation shaft 11, while the drive element 2 can be a belt b pulling the synchronous wheel to rotate the support block 1 (as shown in FIG. 6). Or one end of the rotation shaft 11 can be arranged with a slide block c, while the drive element 2 can be a slide plate d cooperated with the slide block c and arranged on the pull rod 21. When the drive element 2 is pulled repeatedly, the slide block c can be slide through the slide plate d (as shown in FIG. 7). Or, one end of the rotation shaft 11 is arranged with a ratchet wheel e, while the drive element 2 can be a protrusion f cooperated with the ratchet wheel e (as shown in FIG. 8). The protrusion f can push the ratchet wheel e to rotate. The number of support blocks 1 can be arranged according to the specific conditions of the supported materials. If it is a small one, one support block 1 can be arranged at both ends of the material.

Figure 11:
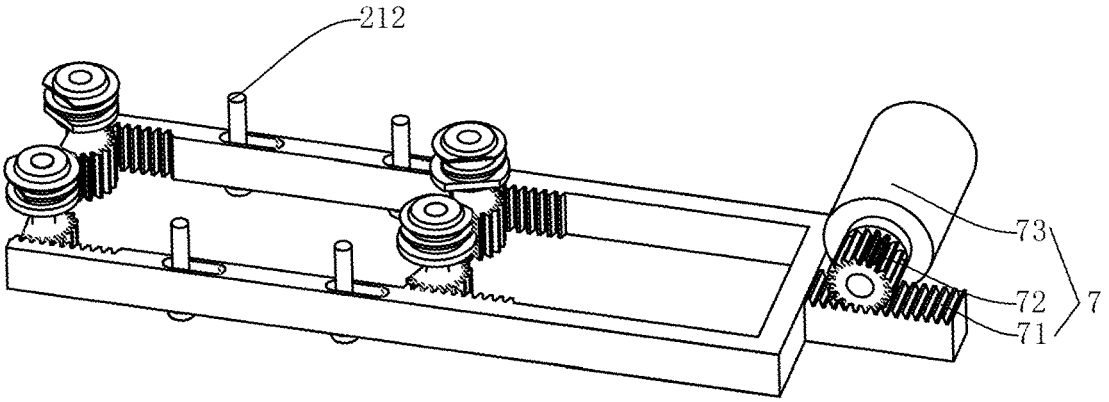
FIG. 11 is a diagram showing the first pull portion in the rotation-type misalignment material discharge structure according to a preferable embodiment of the present application.

As shown in FIG. 11, the pull rod 21 is provided with a positioning pin 212 for guiding the materials (such as the tableware).

Figure 3:
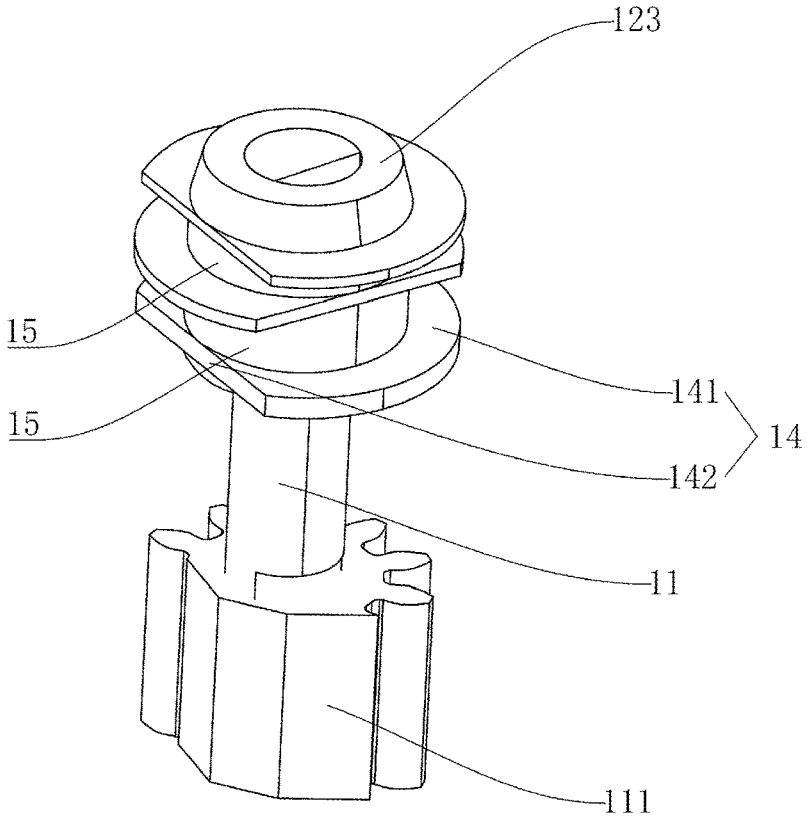
FIG. 3 is a diagram showing the support block and spacing washer in the trilaminar support sheet of the rotation-type misalignment material discharge structure according to a preferable embodiment of the present application.

As shown in FIGS. 2-3, spacing washers 15 having a thickness of one or more times than that of the material, are arranged among the first support sheet 12, the second support sheet 13 and the third support sheet 14, respectively.

As shown in FIG. 11, the pull end 22 is provided with a first pull portion 7 for pulling the drive element 2, which comprises a gear rack 71 connected with the pull end 22, a pull gear 72 meshed with the gear rack 71, and a motor 73 connected with the pull gear 72 for driving the pull gear 72 to roll.

Figure 12:
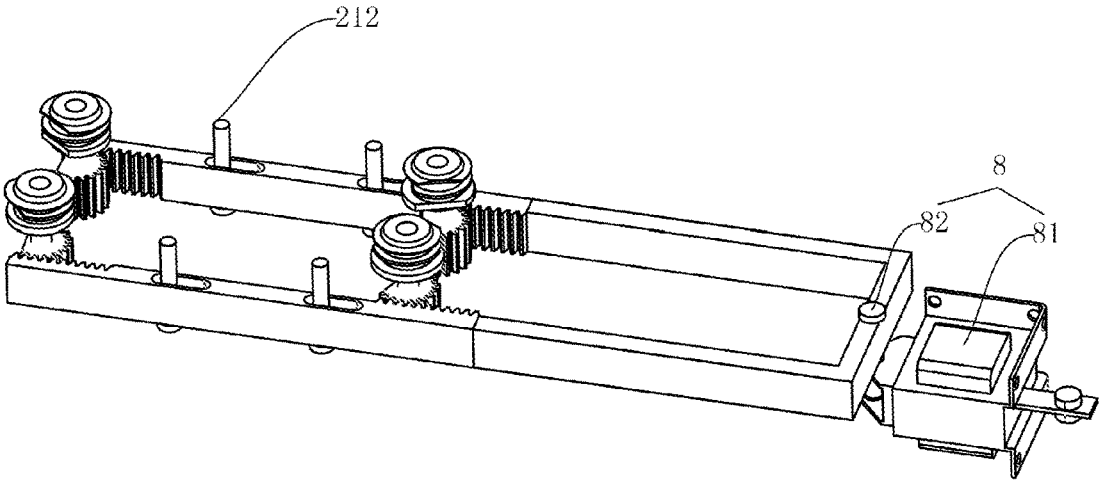
FIG. 12 is a diagram showing the second pull portion in the rotation-type misalignment material discharge structure according to a preferable embodiment of the present application.

As shown in FIG. 12, the pull end 22 is provided with a second pull portion 8 for pulling the drive element 2, which comprises a pulling device 81 and a fixation pin 82 for mounting the pulling device 81 on the pull end 22.

Figure 4:
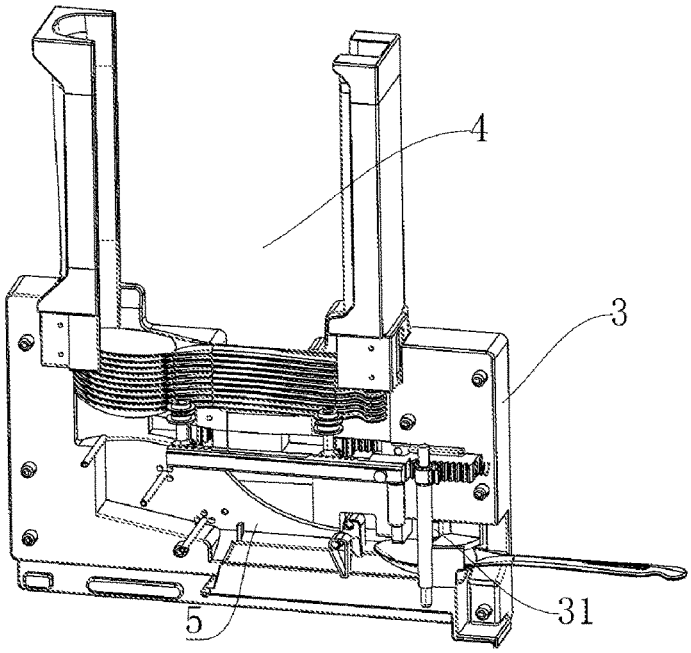
FIG. 4 is a diagram showing the tableware taking device provided with the rotation-type misalignment material discharge structure according to a preferable embodiment of the present application.
Figure 5:
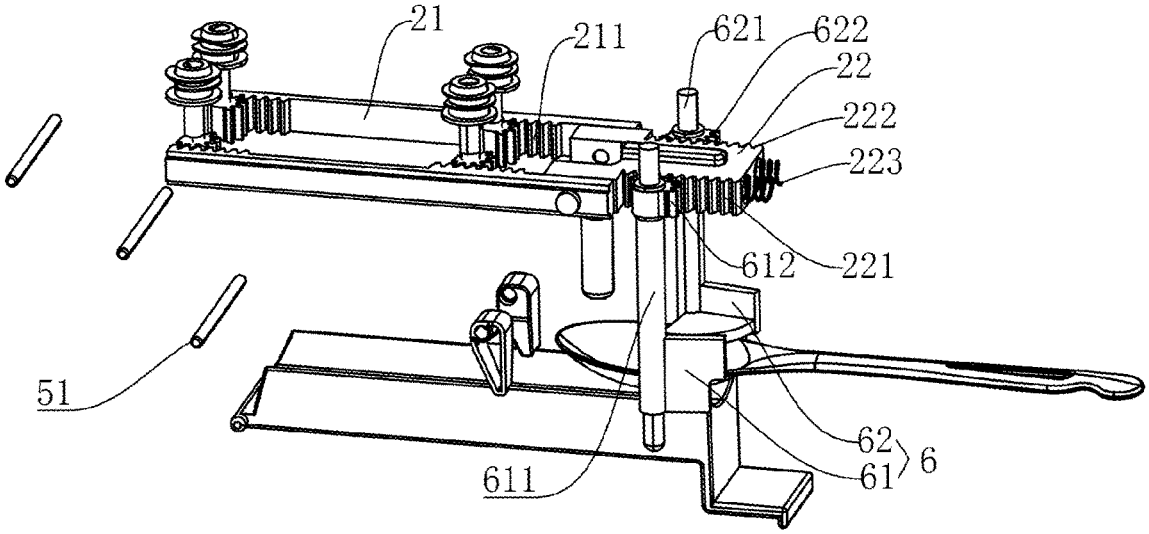
FIG. 5 is a diagram showing the inner structure of the tableware taking device according to a preferable embodiment of the present application.

As shown in FIGS. 4-5, a tableware taking device comprising the above rotation-type misalignment material discharge structure is provided, which comprising a housing 3, a magazine 4 arranged inside the housing 3. The rotation-type misalignment material discharge structure is arranged under the magazine 4. A guide chute 5 for sliding the tableware is formed in the housing 3 and arranged under the rotation-type misalignment material discharge structure. The housing 3 is provided with a tableware taking opening 31 arranged at an end of the guide chute 5.

Preferably, a door opening structure 6 is arranged at the tableware taking opening 31. The door opening structure 6 comprises a first baffle 61 provide with a first connection column 611 and a second baffle 62 provide with a second connection column 621. The first connection column 611 is provided with a first door pulling gear 612 while the second connection column 621 is provided with a second door pulling gear 622. Both sides of the pull end 22 are respectively provided with a first pulling gear pattern 221 meshed with the first door pulling gear 612 and a second pulling gear pattern 222 meshed with the second door pulling gear 622.

When pulling the tableware from the tableware taking opening 31, the tableware can simultaneously pull the first baffle 61 and second baffle 62 to rotate. Meanwhile, the rotation of the first door pulling gear 612 and second door pulling gear 622 can pull the first pulling gear pattern 221 and second pulling gear pattern 222 to move, and meanwhile the gear pattern 211 on the pull rod 21 drives the drive gear 111 arranged on the rotation shaft 11 to bring the support block 1 to rotate for discharging the tableware.

Preferably, the pull end 22 is provided with a reset spring 223 which abuts the housing 3. When pulling the tableware at the tableware taking opening 31, the reset spring 223 is compressed. After taking out the tableware from the tableware taking opening 31, the reset spring 223 drives the rotation-type misalignment material discharge structure to recover.

Preferably, the guide chute 5 comprises three guide columns 51 arranged in parallel with each other, and in a slope-shape or a stair-step shape, successively. The guide column 51 can save materials when comparing with the slop design, and meanwhile simplify the inner structure of the tableware taking device, prevent dust contamination and tableware damage. Of course, the guide chute 5 can employ the stair-step shape for guiding the product. Similar effect can be obtained.

Figure 13:
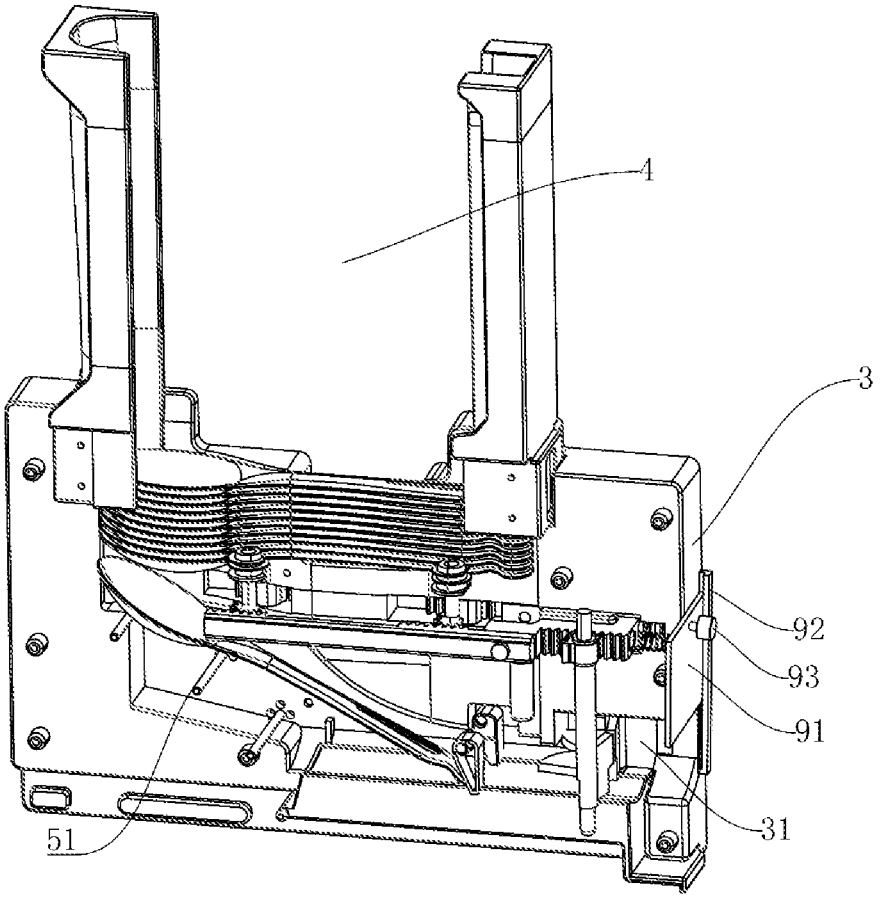
FIG. 13 is a diagram showing the seal insert and position limitation groove in the tableware taking device according to a preferable embodiment of the present application.

As shown in FIG. 13, the tableware taking opening 31 is further arranged with a seal insert 91 and a position limitation groove 92 in which the seal insert 91 can be inserted into and slide therein.

Preferably, a fixation button 93 is arranged on the seal insert 91. The fixation button 93 is easy to grasp for pulling the seal insert 91 to slide in the position limitation groove 92.

The advantages for discharging the tableware by the support block 1 are as follows. (1) The direct discharge can be completed at the accurate position and have high reliability. (2) The tableware discharge does not require the translation movement, thus saving the movement space. (3) Less friction is generated during the pull and move process, and less drive force is required. (4) Less dust and tableware damage are generated by the less friction.

The structure of the drive element 2 is simple and reliable.

The guide chute 5 adopts the design of stair-step, line and point contact, so that the tableware only contacts with the stair-step convex line, and the tableware only has the line and point contact by using the guide columns 51 crossing the guide chute 5, thus reducing the contact area between the tableware and the inclined plane, the slide resistance, and the dust and tableware damage, when compared with the inclined chute in the prior art. In additional, the position of the guide columns 51 can also be adjusted to facilitate obtaining best slide effect.

In the present application, the volume is reduce by saving the forward and backward pushing space, the in-situ material falling is accurate and reliable, and does not need any displacement, so the friction is reduced, the tableware is not easy to be damaged and the dust is not easy to be produced, when comparing with the prior art of moving the material horizontally and then pushing it off.

At present, the products on the market are all packed in bare bags. This design, together with special package bags, can be loaded into this tableware taking device just by the user without the help of the third party. In a preferable embodiment, the magazine 4 is provided with a special package bag. When adding the materials, it is not necessary to take out the materials manually, the materials are just poured into the magazine 4 with the opening of the package bag with the adhesive tape arranged downwardly. When the whole unopened package bag of materials enters the magazine 4 and is located above the support block 1. The adhesive tape can be torn off and the package bag can be pulled out upward to complete the addition. During the whole process, the materials are not be touched by the human hands, thus avoiding the manual contact during the material transportation, addition and usage. This health function is very important for the catering industry in epidemic prevention and resistance.

The foregoing is a further detailed description of the present application in connection with specific preferred embodiments, and cannot be considered as that the specific implementation of the present application is limited to these illustrations. It will be apparent to those skilled in the art that any various modifications or substitutions may be made to the present application without departing from the spirit of the invention, and such modifications or substitutions should be considered as falling within the scope of the present application.

What is claimed is:

1. A rotation-type misalignment material discharge structure comprising a support block and a drive element; wherein the support block further comprises a rotation shaft, a first support sheet and a second support sheet stacked on the rotation shaft successively; wherein the first support sheet comprises a first support portion for supporting a material and a first material discharge portion for discharging the material, the second support sheet comprises a second support portion for supporting the material and a second material discharge portion for discharging the material, wherein the first material discharge portion and the second material discharge portion are misaligned in a perpendicular direction; wherein one end of the rotation shaft is in transmission connection with the drive element; wherein the support block is rotated for discharging the material under a drive of the drive element;

wherein the first material discharge portion and the second material discharge portion are concave notches on the first support sheet and the second support sheet respectively; or the first support portion is a convex portion protruding on the first support sheet, while the second material discharge portion is a concave notch on the second support sheet.

2. The rotation-type misalignment material discharge structure according to claim 1, wherein the support block further comprises a third support sheet, wherein the first support sheet, the second support sheet and the third support sheet are stacked on the rotation shaft successively; wherein the third support sheet comprises a third support portion for supporting the material and a third material discharge portion for discharging the material; wherein the third material discharge portion is a concave notch on the third support sheet, the first material discharge portion , the second material discharge portion and the third material discharge portion are misaligned in the perpendicular direction.

3. The rotation-type misalignment material discharge structure according to claim 2, wherein the first support sheet is provided with a position limitation portion.

4. The rotation-type misalignment material discharge structure according to claim 1, wherein a synchronous wheel is arranged at one end of the rotation shaft, while the drive element is a belt pulling the synchronous wheel to rotate the support block.

5. The rotation-type misalignment material discharge structure according to claim 1, wherein one end of the rotation shaft is arranged with a ratchet wheel, while the drive element is a protrusion cooperated with the ratchet wheel; wherein the protrusion can push the ratchet wheel to rotate.

6. A rotation-type misalignment material discharge structure comprising a support block and a drive element; wherein the support block further comprises a rotation shaft, a first support sheet and a second support sheet stacked on the rotation shaft successively; wherein the first support sheet comprises a first support portion for supporting a material and a first material discharge portion for discharging the material, the second support sheet comprises a second support portion for supporting the material and a second material discharge portion for discharging the material, wherein the first material discharge portion and the second material discharge portion are misaligned in a perpendicular direction; wherein one end of the rotation shaft is in transmission connection with the drive element; wherein the support block is rotated for discharging the material under a drive of the drive element; wherein the drive element comprises two pull rods correspondingly arranged and a pull end respectively connected with the pull rods, wherein at least four support blocks are arranged, each two support blocks are connected with the pull rod on one side of the drive element, one end of the rotation shaft is arranged with a drive gear, the pull rod is provided with a gear pattern meshed with the drive gear, wherein the pull end can pull the four support blocks at the same time under an action of an external force.

7. The rotation-type misalignment material discharge structure according to claim 6, wherein the pull rod is provided with a positioning pin, and spacing washers are arranged among the first support sheet, the second support sheet and a third support sheet, respectively.

8. The rotation-type misalignment material discharge structure according to claim 6, wherein the pull end is provided with a first pull portion for pulling the drive element, wherein the first pull portion comprises a gear rack connected with the pull end, a pull gear meshed with the gear rack, and a motor connected with the pull gear for driving the pull gear to roll.

9. The rotation-type misalignment material discharge structure according to claim 6, wherein the pull end is provided with a second pull portion for pulling the drive element, and the second pull portion comprises a pulling device and a fixation pin for mounting the pulling device on the pull end.

10. The rotation-type misalignment material discharge structure according to claim 6, wherein one end of the rotation shaft is arranged with a slide block, while the drive element is a slide plate cooperated with the slide block and arranged on the pull rod; wherein when the drive element is pulled repeatedly, the slide block can be slid through the slide plate.

11. A tableware taking device comprising a rotation-type misalignment material discharge structure, a housing and a magazine arranged inside the housing, wherein the rotation-type misalignment material discharge structure is arranged under the magazine; wherein a guide chute for sliding a tableware is formed in the housing and arranged under the rotation-type misalignment material discharge structure; wherein the housing is provided with a tableware taking opening arranged at an end of the guide chute; wherein the rotation-type misalignment material discharge structure comprises a support block and a drive element; wherein the support block further comprises a rotation shaft, a first support sheet and a second support sheet stacked on the rotation shaft successively; wherein the first support sheet comprises a first support portion for supporting a material and a first material discharge portion for discharging the material, the second support sheet comprises a second support portion for supporting the material and a second material discharge portion for discharging the material, wherein the first material discharge portion and the second material discharge portion are misaligned in a perpendicular direction; wherein one end of the rotation shaft is in transmission connection with the drive element; wherein the support block is rotated for discharging the material under a drive of the drive element;

wherein the drive element comprises two pull rods correspondingly arranged and a pull end respectively connected with the pull rods, a door opening structure is arranged at the tableware taking opening, wherein the door opening structure comprises a first baffle provide with a first connection column and a second baffle provide with a second connection column; wherein the first connection column is provided with a first door pulling gear while the second connection column is provided with a second door pulling gear; wherein both sides of the pull end are respectively provided with a first pulling gear pattern meshed with the first door pulling gear and a second pulling gear pattern meshed with the second door pulling gear.

12. The tableware taking device according to claim 11, wherein the pull end is provided with a reset spring which abuts the housing.

13. The tableware taking device according to claim 11, wherein the guide chute comprises three guide columns arranged in parallel with each other, and in a slope-shape or a stair-step shape, successively.

14. The tableware taking device according to claim 11, wherein the tableware taking opening is further arranged with a seal insert and a position limitation groove in which the seal insert can be inserted into and slide therein.

15. The tableware taking device according to claim 14, wherein a fixation button is arranged on the seal insert.

16. The tableware taking device according to claim 11, wherein at least four support blocks are arranged, each two support blocks are connected with the pull rod on one side of the drive element, one end of the rotation shaft is arranged with a drive gear, the pull rod is provided with a gear pattern meshed with the drive gear, wherein the pull end can pull the four support blocks at the same time under an action of an external force.

17. The tableware taking device according to claim 11, wherein the first material discharge portion and the second material discharge portion are concave notches on the first support sheet and the second support sheet respectively.

* * * * *